US009074332B1

(12) United States Patent
Matteson

(10) Patent No.: US 9,074,332 B1
(45) Date of Patent: Jul. 7, 2015

(54) FLOOR WATER BARRIER DEVICE

(71) Applicant: Thomas Matteson, Alexandria, MN (US)

(72) Inventor: Thomas Matteson, Alexandria, MN (US)

( * ) Notice: Subject to any disclaimer, the term of this patent is extended or adjusted under 35 U.S.C. 154(b) by 0 days.

(21) Appl. No.: 14/065,488

(22) Filed: Oct. 29, 2013

(51) Int. Cl.
*E02B 7/02* (2006.01)
*E02B 7/00* (2006.01)

(52) U.S. Cl.
CPC ..... *E02B 7/00* (2013.01)

(58) Field of Classification Search
USPC ..... 405/15–18, 21, 30, 31, 107–111, 114; 404/6, 9, 10, 12, 13
See application file for complete search history.

(56) References Cited

U.S. PATENT DOCUMENTS

| | | | | |
|---|---|---|---|---|
| 3,654,730 | A | 4/1972 | Fraleigh | |
| 5,308,670 | A | 5/1994 | Saylor | |
| D350,525 | S | 9/1994 | Robinson | |
| 5,478,625 | A | 12/1995 | Wright | |
| 5,687,516 | A | 11/1997 | Sheehan et al. | |
| 5,689,920 | A * | 11/1997 | Hallsten | 52/169.1 |
| 5,746,538 | A * | 5/1998 | Gunness | 404/6 |
| 5,762,233 | A | 6/1998 | Van Romer | |
| 5,772,357 | A * | 6/1998 | Evans | 404/7 |
| 5,916,658 | A | 6/1999 | Mohr | |
| 6,258,430 | B1 | 7/2001 | Perlman | |
| 7,690,861 | B1 * | 4/2010 | Johnson | 404/12 |

* cited by examiner

*Primary Examiner* — Sunil Singh

(57) ABSTRACT

A floor water barrier device confines water to a desired area within a structure such as a garage. The device includes a barrier having a bottom section having a bottom surface. The barrier has an upper section positioned in spaced relationship to the bottom section. The upper section is substantially coextensive with a length of the lower section. The barrier further has a medial section coupled to and extending between the bottom section and the lower section defining a channel extending along the barrier. The channel is configured to prevent fluid from passing completely over the bottom section. A coupler is coupled to the bottom surface of the bottom section and extends along a length of the bottom section such that the coupler prevents fluid from passing between the barrier and the upper surface of the floor.

1 Claim, 4 Drawing Sheets

FLOOR WATER BARRIER DEVICE

BACKGROUND OF THE DISCLOSURE

Field of the Disclosure

The disclosure relates to barrier devices and more particularly pertains to a new barrier device for confining water to desired area within a structure such as a garage.

SUMMARY OF THE DISCLOSURE

An embodiment of the disclosure meets the needs presented above by generally comprising a barrier including a bottom section having a bottom surface. The barrier has an upper section positioned in spaced relationship to the bottom section. The upper section is substantially coextensive with a length of the bottom section. The barrier further has a medial section coupled to and extending between the upper section and the bottom section defining a channel extending along the barrier. The channel is configured to prevent fluid from passing completely over the bottom section. A coupler is coupled to the bottom surface of the bottom section and extends along a length of the bottom section such that the coupler prevents fluid from passing between the barrier and the upper surface of the floor.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
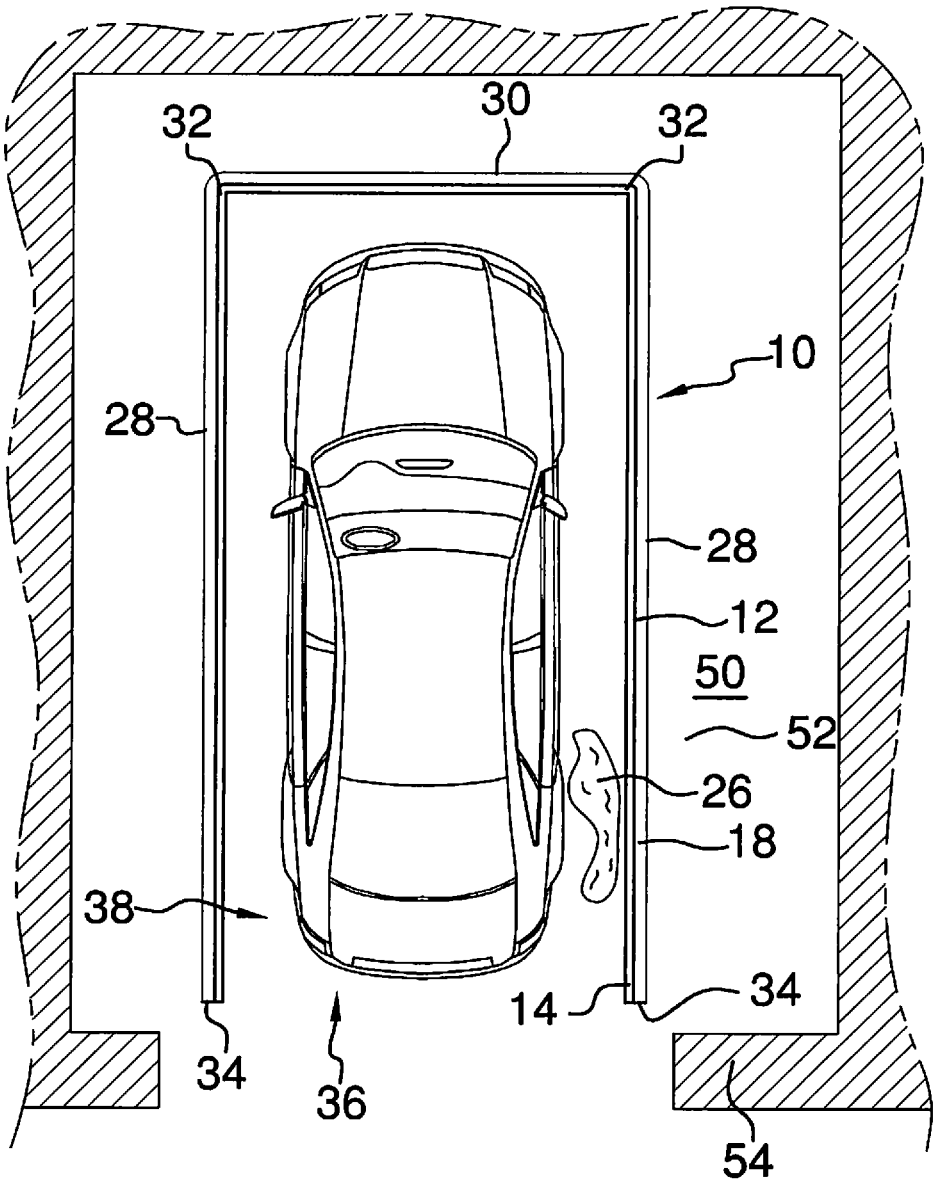
FIG. 1 is a top view of a floor water barrier device according to an embodiment of the disclosure.

With reference now to the drawings, and in particular to FIGS. 1 through 7 thereof, a new barrier device embodying the principles and concepts of an embodiment of the disclosure and generally designated by the reference numeral 10 will be described.

As best illustrated in FIGS. 1 through 5, the floor water barrier device 10 generally comprises a barrier 12 comprising a bottom section 14 having a bottom surface 16 configured to be coupled to an upper surface 50 of a floor 52 of a structure 54 such as a garage or storage space. The barrier 12 further includes an upper section 18 positioned in spaced relationship to the bottom section 14. The upper section 18 is substantially coextensive with a full length of the bottom section 14. The barrier 12 further comprises a medial section 20 coupled to and extending between a back edge 22 of the bottom section 14 and a back edge 24 of the upper section 18 defining a channel 56 extending along the barrier 12. The channel 56 is configured to prevent fluid 26 from passing completely over the bottom section 14. The barrier 12 has a pair of parallel side portions 28 and a medial portion 30 extending between ends 32 of the side portions 28. Each side portion 28 has a distal end 34 relative to the medial portion 30. The distal ends 34 of the side portions 28 are positioned in spaced relationship defining an opening 36 into a space 38 defined by the side portions 28 and the medial portion 30 of the barrier 12. The space 38 may accommodate a vehicle or the like which might be used outside of the structure 54 and moved into the structure 54. The side portions 28 are positioned substantially parallel to each other and the medial portion 30 is positioned substantially transverse to each of the side portions 28 wherein the space 38 defined by the side portions 28 and the medial portion 30 is substantially rectangular, which may include a substantially square space.

A distal section 40 of the upper section 18 relative to the medial section 20 of the barrier 12 is curved forming a bulbous lip 42 extending along a distal edge 44 of the upper section 18 relative to the medial section 20. The distal section 40 curves downwardly towards the bottom section 14 wherein the lip 42 is configured for preventing fluid 26 from moving from the channel 56 over the upper section 18 of the barrier 12.

A distal surface 46 of the bottom section 14 relative to the medial section 20 is angled relative to the bottom surface 16 of the bottom section 14. Thus, an edge portion 48 of the bottom section 14 tapers extending away from the medial section 20 to further promote the fluid 26 to move away from the channel 56. The edge portion 48 of the bottom section 14 may be fully positioned outside the channel 56 by being positioned offset from the lip 42 above the bottom section 14.

A coupler 60 is coupled to the bottom surface 16 of the bottom section 14 of the barrier 12. The coupler 60 extends substantially and consistently along a full length of the bottom section 14 such that the coupler 60 is configured to prevent fluid 26 from passing between the barrier 12 and the upper surface 50 of the floor 52. The coupler 60 may be an adhesive 62 coupled to and extending along a length of the bottom surface 16 of the bottom section 14 of the barrier 12. A sealing member 66 or gasket may be employed between the bottom surface 16 of the bottom section 14 and the upper surface 50 of the floor 52. A backing 68 is removably coupled to the bottom surface 16 of the bottom section 14 of the barrier 12 or the sealing member 66. The backing 68 covers the adhesive 62 until the backing 68 is removed to permit coupling of the barrier 12 to the upper surface 50 of the floor 52.

Figure 2:
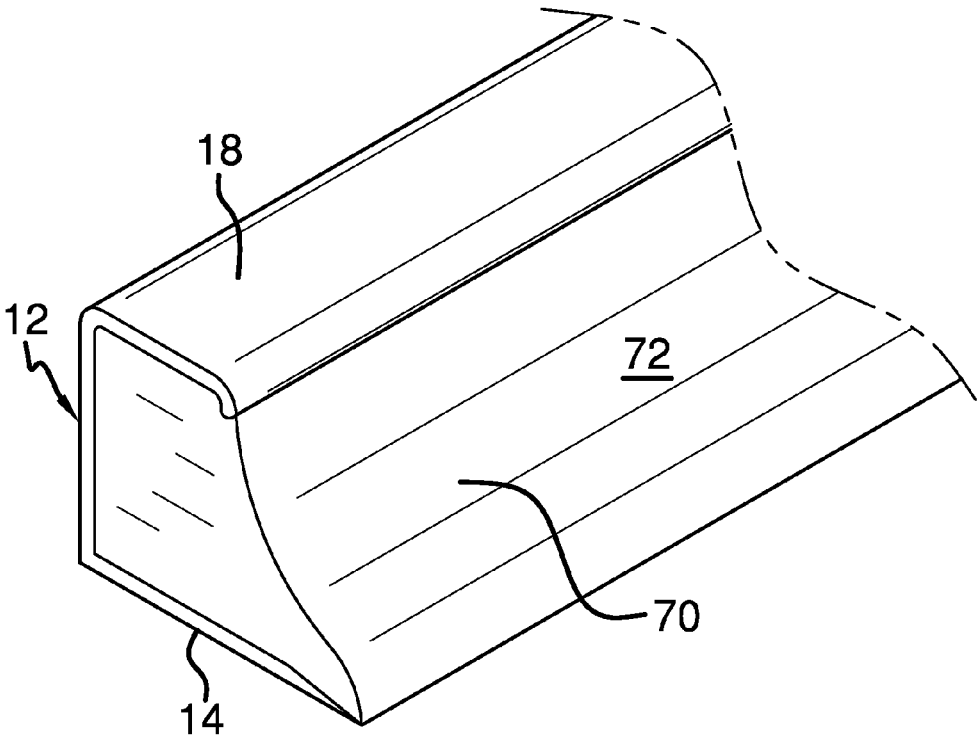
FIG. 2 is a top front side perspective view of an embodiment of the disclosure.
Figure 3:
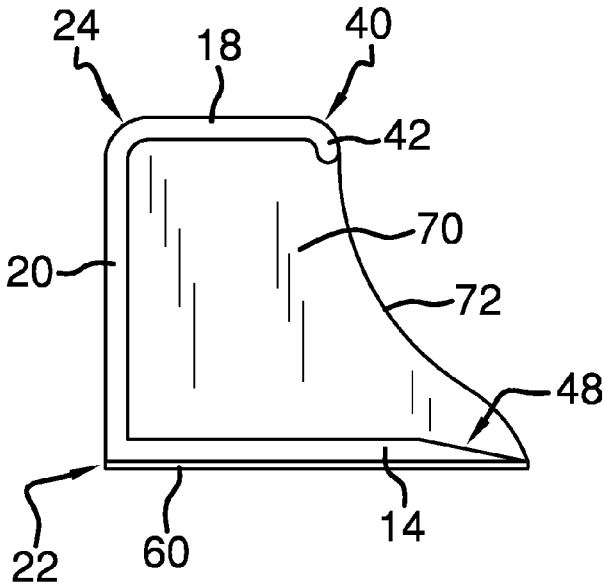
FIG. 3 is a side view of an embodiment of the disclosure.
Figure 4:
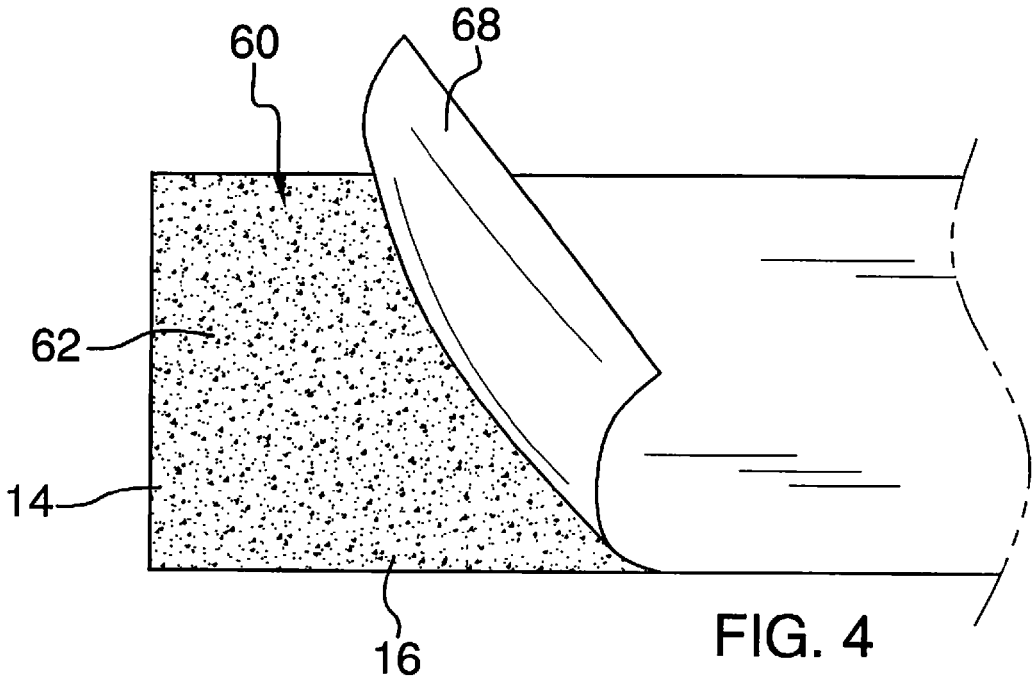
FIG. 4 is a bottom view of an embodiment of the disclosure.
Figure 5:
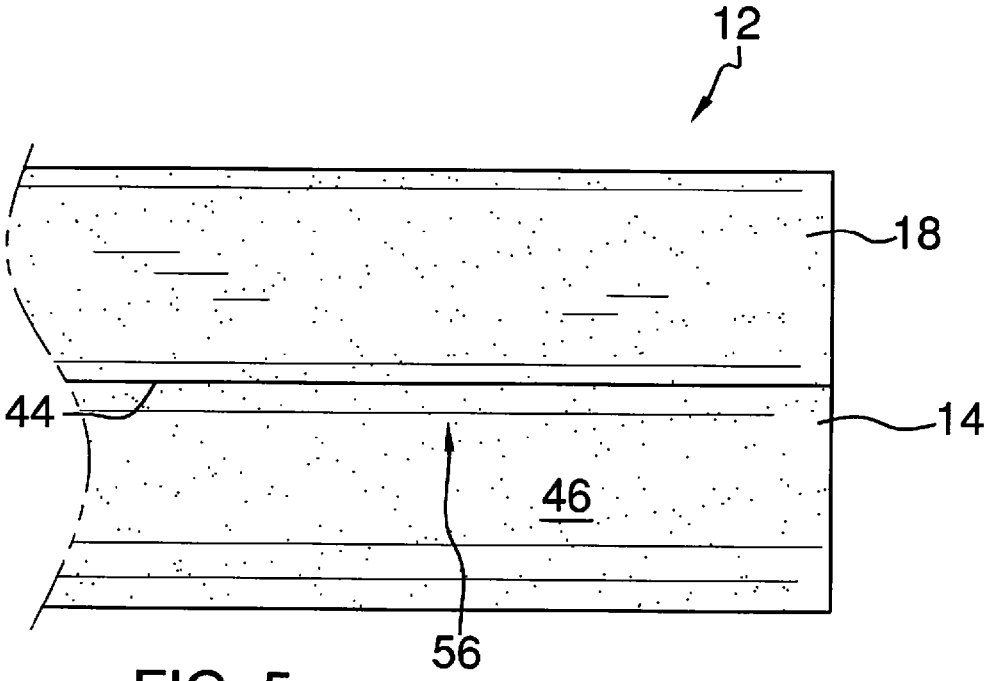
FIG. 5 is a top view of an embodiment of the disclosure.

As shown in FIGS. 2 and 3, an embodiment of the disclosure may include an insert 70 coupled to the barrier 12. The insert 70 is positioned in and fills the channel 56. A face 72 of the insert 70 extends between the upper section 18 and the bottom section 14. The face 72 is S-shaped transverse to a longitudinal axis of the insert 70 to promote retention of water and debris in a confined area.

Figure 6:
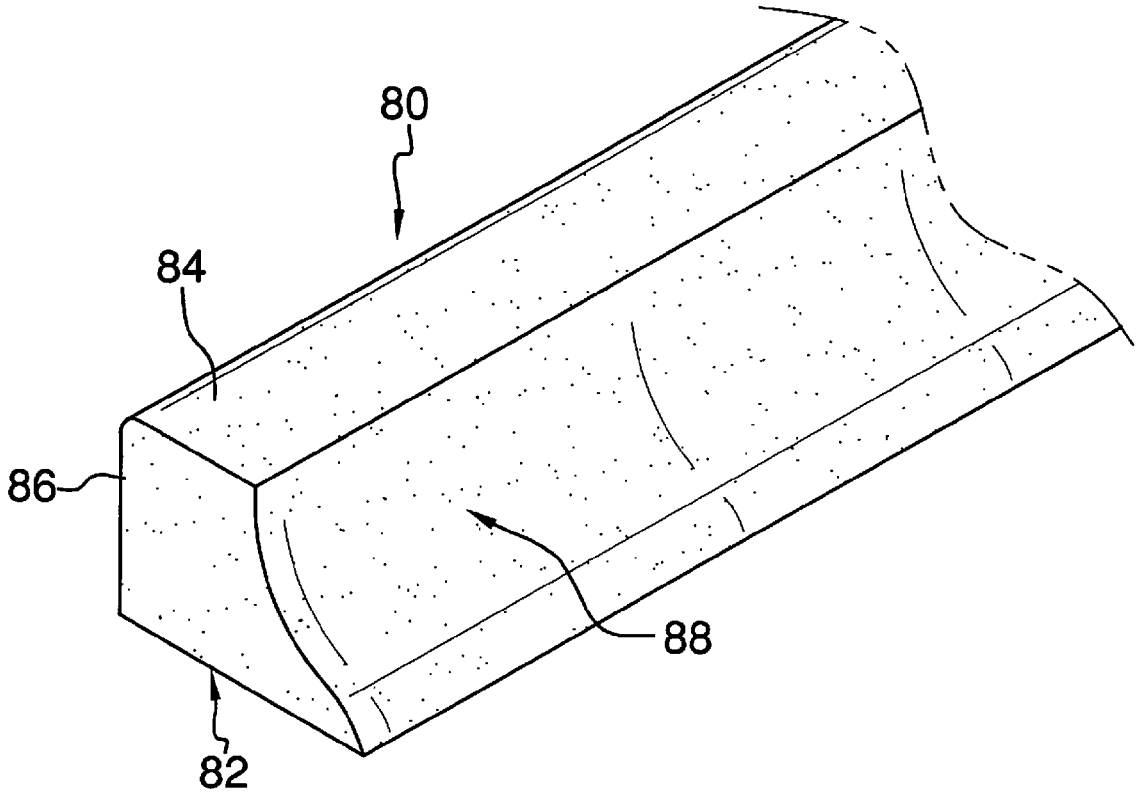
FIG. 6 is a top front side perspective view of an embodiment of the disclosure.
Figure 7:
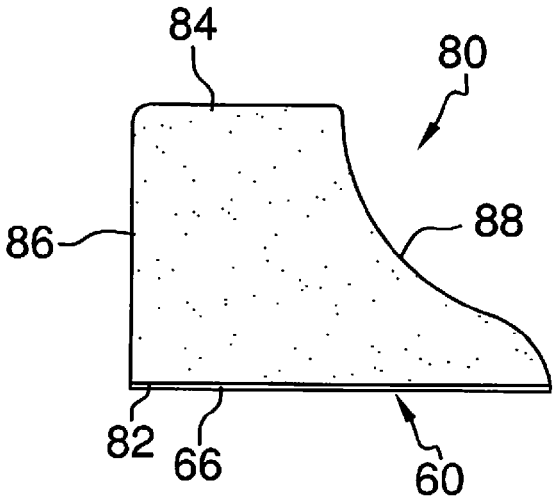
FIG. 7 is a side view of an embodiment of the disclosure.

In an embodiment shown in FIGS. 6 and 7, a barrier 80 may be a single material comprising a bottom surface 82, an upper surface 84 positioned in spaced relationship to said bottom surface 82. The upper surface 84 is substantially coextensive with a length of the lower surface 82. The barrier 80 further comprises a medial section 86 coupled to and extending between the bottom surface 82 and the lower surface 84 extending along the barrier 80 wherein the barrier 80 is similar in structure to the barrier 12 and insert 70 described above including a face 88 of the medial section 86 extending between the upper surface 84 and the bottom surface 82 being S-shaped transverse to a longitudinal axis of the medial section 86. The barrier 80 may otherwise be similarly coupled to the floor and utilized in the same manner as the barrier 12.

In use, the barrier 12 is installed in the structure 54 where it serves to encompass the space 38 where a vehicle, snowblower, or other object might be typically stored. Fluid 26 in a liquid state, or a frozen state, may collect on such objects during their use outside of the structure 54. Upon return of the object to the structure 54, the barrier 12 serves to restrict the collected fluid 26 to the space 38 preventing the fluid 26 from damaging other items which may be stored in the structure 54 adjacent to the space 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A water barrier device for a floor of a structure, the device comprising:

a barrier comprising a bottom section having a bottom surface, an upper section positioned in spaced relationship to said bottom section, said upper section being substantially coextensive with a length of said bottom section, said barrier further comprising a medial section coupled to and extending between said upper section and said bottom section defining a channel extending along said barrier, said upper section and said bottom section each extending outwardly from said medial section wherein said channel is configured to prevent fluid from passing completely over said bottom section, said barrier having a pair of parallel side portions and a medial portion extending between ends of said side portions, each said side portion having a distal end relative to said medial portion, said distal ends of said side portions being positioned in spaced relationship defining an opening into a space defined by said side portions and said medial portion of said barrier, said side portions being positioned substantially parallel to each other, said medial portion being positioned substantially transverse to each of said side portions wherein said space defined by said side portions and said medial portion is substantially rectangular;

an insert coupled to said barrier, said insert being positioned in and filling said channel, a face of said insert extending between said upper section and said bottom section being smoothly curved to be S-shaped transverse to a longitudinal axis of said insert such that said face is substantially vertical extending from said upper section and approaches being vertical approaching said bottom section;

a distal section of said upper section relative to said medial section of said barrier being curved forming a lip extending along a distal edge of said upper section relative to said medial section, said distal section curving downwardly towards said bottom section wherein said lip is configured for retaining said insert in said channel;

a distal surface of said bottom section relative to said medial section being angled relative to said bottom surface of said bottom section wherein an edge portion of said bottom section tapers extending away from said medial section;

a coupler coupled to said bottom surface of said bottom section of said barrier, said coupler extending along a length of said bottom section such that said coupler is configured to prevent fluid from passing between said barrier and the upper surface of the floor, said coupler being an adhesive coupled to and extending along a length of said bottom surface of said bottom section of said barrier; and a backing removably coupled to said bottom surface of said bottom section of said barrier, said backing covering said adhesive until said backing is removed to permit coupling of said barrier to the upper surface of the floor.

* * * * *